United States Patent [19]

Scheying

[11] 4,259,040

[45] Mar. 31, 1981

[54] FUEL INJECTION PUMP FOR AIR-COMPRESSING FUEL-INJECTED INTERNAL COMBUSTION ENGINE

[75] Inventor: Heinz Scheying, Stuttgart, Fed. Rep. of Germany

[73] Assignee: Daimler-Benz Aktiengesellschaft, Stuttgart, Fed. Rep. of Germany

[21] Appl. No.: 69,055

[22] Filed: Aug. 23, 1979

[30] Foreign Application Priority Data

Aug. 26, 1978 [DE] Fed. Rep. of Germany ..... 2837297

[51] Int. Cl.[3] ..... F02M 45/06

[52] U.S. Cl. ..... 417/493; 417/498; 417/510; 123/300

[58] Field of Search ..... 417/493, 494, 498, 499, 417/510; 123/300, 451, 495, 500, 505

[56] References Cited

U.S. PATENT DOCUMENTS 4,178,141 12/1979 Scheying ..... 417/498

FOREIGN PATENT DOCUMENTS 572711 3/1933 Fed. Rep. of Germany ..... 417/493
1169198 4/1964 Fed. Rep. of Germany ..... 417/493
1187857 2/1965 Fed. Rep. of Germany ..... 417/493
1037770 9/1953 France ..... 417/493
4735246 6/1967 Japan ..... 417/499
342791 1/1960 Switzerland ..... 417/493

*Primary Examiner*—Leonard E. Smith
*Attorney, Agent, or Firm*—Craig and Antonelli

[57] ABSTRACT

A fuel injection pump for an air-compressing fuel-injected internal combustion engine which includes a first pump piston arranged in each pump cylinder for regulating a fuel control bore of a pump working chamber. A control element cooperable with the pump piston controls a flow of fuel in the injection pump. The control element is provided with a bore arrangement by way of which the pump working chamber is connected with a pump pressure chamber. An intermediate chamber is arranged between the pump working chamber and the pump pressure chamber from which two separate feed lines terminate into the pump pressure chamber in such a way that a feed stream of fuel is conducted by way of the first feed line arranged in the control cylinder with temporal interruption by the control element but that this feed stream is constantly conducted by way of the second feed line which acts as a throttle.

8 Claims, 1 Drawing Figure

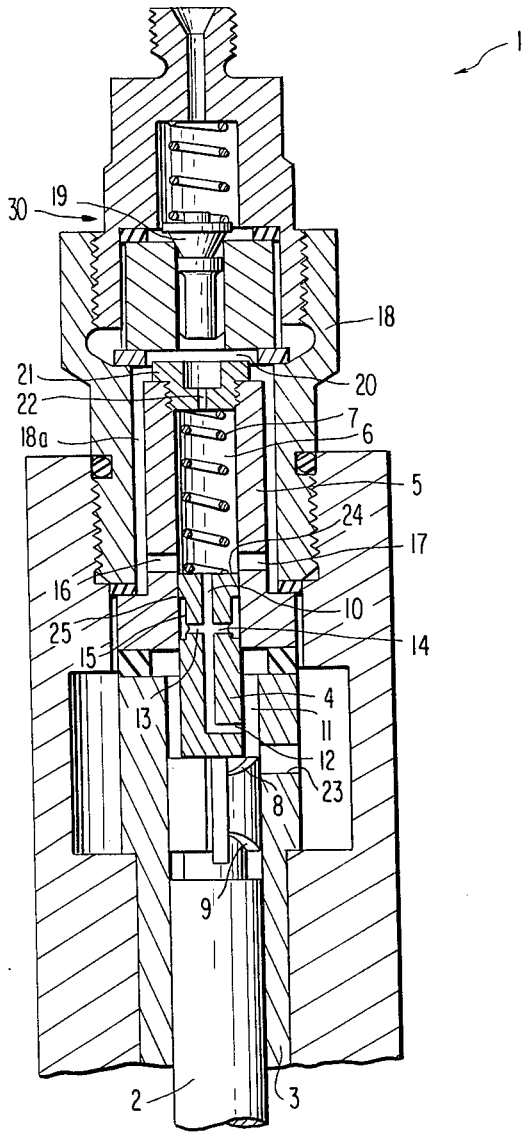
1
30
19
18
21
22
18a
20
7
6
5
24
17
16
10
25
14
15
4
13
11
12
23
8
9
2
3

FUEL INJECTION PUMP FOR AIR-COMPRESSING FUEL-INJECTED INTERNAL COMBUSTION ENGINE

The present invention relates to an injection pump and, more particularly, to a fuel injection pump for an air-compressing fuel-injected internal combustion engine with the injection pump including a first piston arranged in each pump cylinder for regulating a fuel control bore in a pump working chamber and a second piston arranged above the first piston serving for the fuel control, which second piston includes a bore arrangement for connecting the pump working chamber with a pump pressure chamber.

Fuel injection pumps of the aforementioned type have been proposed in, for example, Offenlengungsschrift No. 26 33 671 wherein first a small amount of fuel is injected and then, without temporal interruption, a large amount of fuel is injected due to the special cooperation between the two pump pistons which are not constantly directly connected with each other.

The aim underlying the present invention essentially resides in providing a fuel injection pump for an air-compressing fuel-injected internal combustion engine by means of which a smoother transition from the small fuel quantity to a larger fuel quantity is obtained, as compared to, for example, the injection pump of the aforementioned Offenlengungsschrift, so that an even quieter and more stable operation of the internal combustion engine is made possible over the entire load range.

In accordance with the present invention, an intermediate chamber is arranged between the pump working chamber and the pump pressure chamber with two separate feed lines terminating from the intermediate chamber into the pump pressure chamber in such a manner that the feed stream of fuel is conveyed by a control element through the first feed lines in a control cylinder, with a temporal interruption, but the feed stream is constantly conveyed by way of the second feed line which acts as a throttle.

By virtue of the above features of the present invention, the control of the preliminary feed of the fuel injection is improved especially at low rotational speeds of the injection pump.

In accordance with an advantageous feature of the present invention, the second feed line is fashioned as a throttle bore and arranged between the intermediate chamber and the pump pressure chamber. Moreover, the control element of the present invention may be fashioned as a control slide which is in constant contact with the pump piston.

In accordance with further advantageous features of the present invention, the bore arrangement in the control slide may include a longitudinal bore and a transverse bore connected with the longitudinal bore and terminating in the pump working chamber with transverse bores branching off the longitudinal bore which transverse bores are temporarily in communication with the first feed line in the control cylinder.

Accordingly, it is an object of the present invention to provide a fuel injection pump for air-compressing fuel-injected internal combustion engines which avoids, by simple means, shortcomings, and disadvantages encountered in the prior art.

Another object of the present invention resides in providing a fuel injection pump for air-compressing fuel-injected internal combustion engines which ensures a smooth transition from a preliminary injection to a full injection.

Another object of the present invention resides in providing a fuel injection pump for air-compressing fuel-injected internal combustion engines which ensures a quieter and stable operation of the internal combustion engine over the entire load range thereof.

A further object of the present invention resides in providing a fuel injection pump for air-compressing fuel-injected internal combustion engines which is simple in construction and therefore relatively inexpensive to manufacture.

Another object of the present invention resides in providing a fuel injection pump for air-compressing fuel-injected internal combustion engines which functions reliably under all operating conditions.

These and other objects, features, and advantages of the present invention will become more apparent from the following description when taken in connection with the accompanying drawing which shows, for the purposes of illustration only, one embodiment in accordance with the present invention, and wherein:

The single FIGURE is a longitudinal cross-sectional view of a fuel injection pump for an air-compressing fuel-injected internal combustion engine in accordance with the present invention.

Referring now to the single FIGURE of the drawing, according to this figure, a pump element generally designated by the reference numeral 1 of an injection pump for air-compressing fuel-injected internal combustion engines includes a pump piston 2 which is longitudinally displaceably guided in a pump cylinder 3 and a control element 4 directly resting on the pump piston 2, which control element 4 is constructed as a control slide. The control element 4 is arranged in a control cylinder 5 and urged by a compression spring 7, accommodated in an intermediate chamber 6 which serves as a fuel reservoir, into abutment with the pump piston 2.

The pump piston 2, driven by a cam of a driveshaft (not shown) is provided with a top-positioned control edge 8 for controlling the beginning of the fuel feeding step as well as a bottom-positioned control edge 9 for defining the end or termination of the fuel feeding.

A bore arrangement is provided in the control slide 4 and includes a longitudinal bore 10 terminating in the intermediate chamber, a transverse bore 12 connected to the longitudinal bore and leading into a pump working chamber 11, and two further transverse bores 13, 14 branching off from the longitudinal bore 10 and being in communication with an annular chamber 15.

Radial bores 16, 17, branching off from the intermediate chamber 6, terminate in an annular chamber 18*a* arranged between the control cylinder 5 and an inner wall of a threaded section 18 which mounts a pressure valve generally designated by the reference numeral 30 at the pump element. The annular chamber 18 is in communication with a pump pressure chamber 20 disposed beneath a relief valve 19 of the pressure valve 30. An end piece 21 is interposed between the pump pressure chamber 20 and the intermediate chamber 6. The end piece 21 includes a throttle bore 22 which is threaded into the control cylinder 5. Fuel from the pump working chamber 11 constantly enters the pump pressure chamber 20 during a pumping operation through the end piece 21.

The mode of operation of the pump element of the injection pump of the present invention is as follows:

The fuel quantity conveyed by the feed pump (not shown) passes by way of a control bore 23 arranged in the pump cylinder 3 so as to fill, at the bottom dead center position of the pump piston 2, the pump working chamber 11, the intermediate chamber 6, and the pump pressure chamber 20. During the upward stroke of the pump piston 2, the top-positioned control edge 8 seals off the control bore 23. Starting with this point in time, after a lifting of the biased relief valve 19, the preliminary conveying step begins which lasts until the control edge 24 of the control slide 4 interrupts the fuel conveying step through the radial bores 16, 17.

Upon a further stroke of the piston 2, the control edge 25 of the annular chamber 15 vacates or opens the radial bores 16, 17 so that the principal fuel conveying step begins.

The fuel control aspect of the pump element 1 of the present invention is such that at high speed, during the preliminary feeding step, a greater quantity of fuel passes through the radial bores 16, 17 and a lesser quantity passes through the throttle bore 22; whereas, at low speed, a greater quantity of fuel passes through the throttle bore 22.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A fuel injection pump for an air-compressing fuel-injected internal combustion engine, the fuel injection pump including at least one pump cylinder means, a pump piston means arranged in each pump cylinder means for regulating a fuel control bore of a pump working chamber means, a control element cooperable with the pump piston means for controlling a flow of fuel in the injection pump, and means provided in the control element for communicating the pump working chamber means with a pump pressure chamber means, characterized in that an intermediate chamber means is arranged between the pump working chamber means and the pump pressure chamber means, a first fuel feed means is arranged in a control cylinder for communicating the pump working chamber means with the pump pressure chamber means, a second fuel feed means including a throttle means is arranged in the injection pump for providing a separate fuel feed to the pump working chamber means, and in that means are provided on the control element for controlling the first and second fuel feed means such that a stream of fuel fed by said first fuel feed means is interrupted by the control element while the stream of fuel is constantly conducted by said second fuel feed means.

2. A fuel injection pump according to claim 1, characterized in that the second fuel feed means is arranged between the intermediate chamber means and the pump pressure chamber means, and in that the throttle means is constructed as a throttle bore.

3. A fuel injection pump according to one of claims 1 or 2, characterized in that the control element is constructed as a control slide means, and in that means are provided for urging the control slide means into constant contact with the pump piston means.

4. A fuel injection pump according to claim 3, characterized in that means provided in the control element for communicating the pump working chamber means with the pump pressure chamber means includes a bore arrangement provided in the control slide means, the bore arrangement including a longitudinal bore and a transverse bore communicating with the longitudinal bore and terminating in the pump working chamber means, and in that at least a pair of additional transverse bores branch off from the longitudinal bore with the additional transverse bores being adapted to be temporarily placed in communication with the first fuel feed means.

5. A fuel injection pump according to claim 4, characterized in that an annular chamber means is provided for communicating the first fuel feed means with the pump working chamber means.

6. A fuel injection pump according to claim 5, characterized in that the first fuel feed means includes at least a pair of radial bores for communicating the intermediate chamber means with the annular chamber means.

7. A fuel injection pump according to claim 6, characterized in that the pair of additional transverse bores terminate in an annular chamber formed in the control slide means.

8. A fuel injection pump according to claim 7, characterized in that said controlling means provided on said control element includes a first control edge means positioned at an upper portion of the control element cooperable with the radial bores so as to interrupt a flow of fuel therethrough, and a second control edge means spaced from said first control edge means for reestablishing communication between the radial bores and the annular chamber means.

* * * * *